US007960661B2

(12) United States Patent
Wlotzka

(10) Patent No.: US 7,960,661 B2
(45) Date of Patent: Jun. 14, 2011

(54) MULTIFUNCTIONAL ROTARY SWITCH

(75) Inventor: Paul Wlotzka, Nürtingen (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 519 days.

(21) Appl. No.: 12/106,923

(22) Filed: Apr. 21, 2008

(65) Prior Publication Data

US 2008/0257701 A1 Oct. 23, 2008

(30) Foreign Application Priority Data

Apr. 20, 2007 (EP) ..... 07008116

(51) Int. Cl.
*H01H 25/06* (2006.01)

(52) U.S. Cl. ..... 200/14; 200/4; 200/5 R

(58) Field of Classification Search ..... 200/4, 5 R, 200/14, 11 R, 11 A, 11 C, 11 TW, 17 R, 18
See application file for complete search history.

(56) References Cited

U.S. PATENT DOCUMENTS

| | | | | |
|---|---|---|---|---|
| 6,218,635 | B1 * | 4/2001 | Shigemoto et al. | 200/14 |
| 6,271,488 | B1 * | 8/2001 | Sasaki | 200/4 |
| 6,774,322 | B2 * | 8/2004 | Morinishi et al. | 200/5 R |
| 6,967,293 | B1 * | 11/2005 | Chen et al. | 200/14 |
| 2004/0046751 | A1 | 3/2004 | Heimermann et al. | |

FOREIGN PATENT DOCUMENTS

| | | | |
|---|---|---|---|
| DE | 103 15 721 | A1 | 11/2004 |
| EP | 1 006 546 | A2 | 6/2000 |
| EP | 1 182 851 | A1 | 2/2002 |
| GB | 2 260 598 | A | 4/1993 |

* cited by examiner

*Primary Examiner* — Renee Luebke
*Assistant Examiner* — Marina Fishman
(74) *Attorney, Agent, or Firm* — The Eclipse Group LLP

(57) ABSTRACT

A multifunctional rotary switch for operating an electronic device is providing having a roller with an axis of rotation. The roller has a bidirectional rotational mode of operation where the roller rotates in both a clockwise and counter clockwise direction around the axis, a translational mode of operation where the roller is moved in a direction substantially parallel to the axis of rotation and a pushing mode of operation where the roller is moved in a direction substantially perpendicular to the axis of rotation.

24 Claims, 4 Drawing Sheets

MULTIFUNCTIONAL ROTARY SWITCH

RELATED APPLICATIONS

This application claims priority of European Patent Application Serial Number 07 008 116.1, filed on Apr. 20, 2007, titled MULTIFUNCTION ROTARY SWITCH, which application is incorporated in its entirety by reference in this application.

BACKGROUND OF THE INVENTION

1. Field of the Invention

The invention relates to a rotary switch with added functionality. In particular, the invention relates to a rotary switch that apart from its rotary mode of operation includes a translational mode of operation and a pushing mode of operation.

2. Related Art

Recently, complex electronic devices are being integrated into the dashboards of vehicles. These electronic devices provide a variety of functions, which results in the need for a multitude of control elements for executing these functions. Control elements presently used include switches, rockers, knobs, push buttons and the like. On the other hand, a need exists for displaying more information related to the electronic devices, which results in an increased size of the displays of electronic devices. For example, navigation systems need to display a certain area of a map. With the increased display size, the amount of space available for control elements becomes smaller. Thus, control elements need to be compact and need to provide a high degree of functionality.

Furthermore, if a driver wants to operate an electronic device, the driver gets distracted if he has to use several control elements to achieve a certain function. A single control element that enables access to most of the functions of the electronic device would be very advantageous since the driver could control the device without taking his hand off the control element.

A need therefore exists to provide a control element that is very compact and that provides a high degree of functionality so that the user can access most functions of the electronic device that the control element operates.

SUMMARY

A multifunctional rotary switch for operating an electronic device is provided. The rotary switch has three modes of operation. The rotary switch has a bidirectional rotational mode of operation about its axis of rotation and a translational mode of operation where the translation takes place substantially parallel to the axis of rotation. The switch further includes a pushing mode of operation where the switch is moved in a direction substantially perpendicular to the axis of rotation.

In another example of an implementation, the rotary switch includes a roller with an axis of rotation. The roller further has a bidirectional rotational mode of operation around the axis, a translational mode of operation parallel to the axis and a pushing mode of operation perpendicular to the axis. The roller further includes at least one detecting mechanism arranged substantially inside the roller for detecting a movement parallel to said axis. In an alternative implementation, the detecting mechanism may be located substantially outside the roller. In still another implementation, the switch may further include an arrest mechanism for arresting the rotation of the roller around the axis in the rotational mode of operation at a predetermined angle.

The rotary switch may be designed to be very compact while providing a high degree of functionality. The functions that are associated with a certain mode of operation can be chosen depending on the electronic device that the switch is to operate. For example, the rotational mode of operation could be used to change the volume of an audio device, to scroll through songs on a play list of a music player or to scroll through the functions of a menu, while the translational mode of operation could be used to skip between songs of a play list, or to bring up different menus, or to skip between locations when used to control a navigational device, while the pushing mode of operation could be used to select a song, to select a navigational target, or to select a function from a menu, or the like. Since, for example, an audio device and a navigational device may be included in the same electronic device. Accordingly, the functionality of the multifunctional rotary switch may change depending upon the device in which the switch is controlling. Providing these three modes of operation in one switch makes the switch small, whereby it can be arranged even on an electronic device with a larger display. The switch may also be arranged on other parts of the dashboard or other surfaces inside the vehicle such as the steering wheel or the center console. The small size of the switch facilitates the arrangement thereof at any given place inside the vehicle. The switch may also be used outside the vehicle. For example, the switch may be mounted on consumer electronic devices, such as audio systems, handheld devices, entertainment systems, portable navigation devices (PNDs) and MP3 players.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
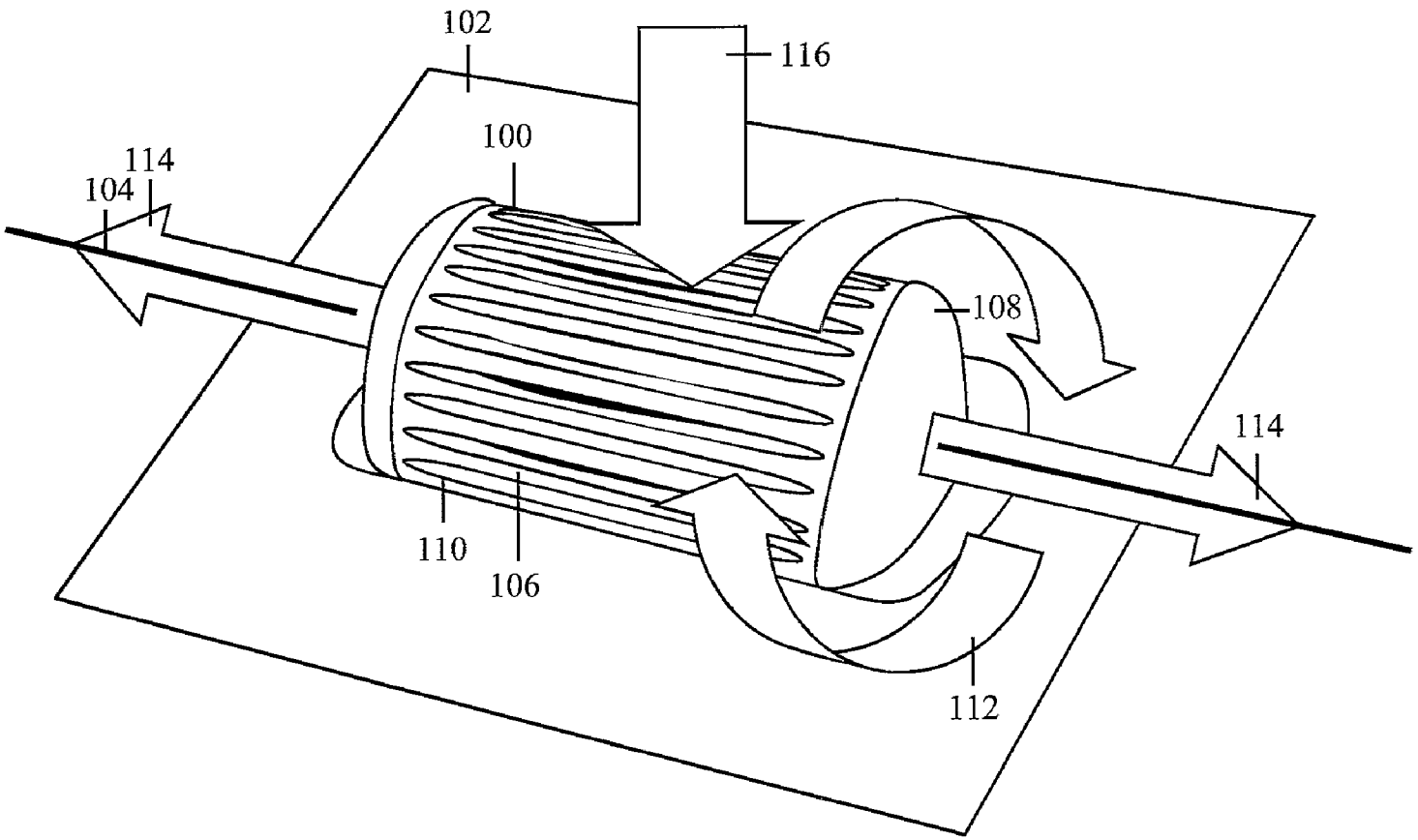
FIG. 1 is a perspective view of one example of an implementation of a multifunctional rotary switch.

FIG. 1 shows one example of an implementation of a multifunctional rotary switch 100 mounted to the surface or plate 102 of a component. The component could be any electronic device, such as an audio device, or simply a surface for control elements of an electronic device. For example, the multifunctional rotary switch 100 may be mounted on a front surface inside a vehicle. The front surface could be a face plate of a navigational device or of an audio device. It may also be another vehicle component such as a dashboard, a steering wheel, a door or a center console. The multifunctional rotary switch 100 can be mounted in such a way that the axis of rotation of the roller is in the same plane as the surface, or it could be mounted such that the axis of rotation lies above or below the surface. Depending on the position of the axis of rotation, a different fraction of the circumferential face of the roller is exposed. The position of the axis of rotation can be chosen in accordance with the space available on the front surface.

The rotary switch 100 includes a roller 106 having covers 108 arranged at the end surfaces of the roller 106. In the illustrated example, the roller 106 is formed in the shape of a cylinder. Alternatively, the roller 106 may also be formed in the shape of a spindle with cut off tips, or in the shape of an hourglass. The switch 100 is mounted to the surface 102 such that the axis of rotation 104 of the roller 106 is substantially parallel to the surface 102 of the component.

Covers 108 are further arranged at the end surfaces of the roller 106 along the axis of rotation 104. The covers 108 may have a semi-spheroidal shape and may be formed of a rubber-like material, plastic material or other flexible material. The covers 108 may be formed of an oblate or a prolate semi-spheroid or a part of such a spheroid, whereby the spheroid is cut in such a way that the end face of the roller 106 coincides with the cut face of the spheroid. The covers 108 may alternatively be cone-shaped. The covers 108 should be formed in such a shape that a good grip is provided, the translational mode of operation of the switch can be easily operated and a smooth transition between the roller 106 and the covers 108 may be formed.

Projections 110 protrude from the circumferential face of the roller 106. The projections 110 may have the shape of a rips positioned parallel to the axis of rotation and prevent slipping when the roller 106 is rotated by hand. They may also be formed in the shape of knobs protruding from the circumferential face, or any other form that prevents slipping. The projections 110 may be formed of a rubber-like material, but may also be formed of the same material as the roller, plastic material, metal, or other flexible material of a shape and type to avoid slipping when the multifunctional rotary switch is operated by hand. Accordingly, when the user moves his finger over the rotary switch intending to actuate the rotational mode of operation, the high friction between the finger and the surface of the roller that is covered with projections 110 ensures that the roller 106 is operated. In this regard, the electronic device to which the switch 100 is mounted may be operated even with wet or greasy fingers. In the illustrated example, the covers 108 of the switch 100 are formed of a part of an oblate spheroid. They may also be formed in another shape such as a semi-spherical shape or a cone shape or other shape to provide precise and comfortable operation of the switch 100.

FIG. 1 illustrates three modes of operation of the switch 100. As indicated by arrows, in the rotational mode of operation 112, the roller 106 is rotated around the axis of rotation 104. Although only one direction or rotation is indicated, the roller 106 can be operated bidirectionally. Similarly, the translational mode of operation 114 is indicated by arrows. The roller 106 to which both covers 108 are mounted can be moved substantially parallel to the axis of rotation 104, whereby the covers 108 provide a precise operation and a safe grip. The roller has a central position along the axis of rotation 104 to which it returns after it has been pushed in either one of the translational directions. The switch 100 is operated in the pushing mode of operation 116 by pushing the roller 106 substantially perpendicular to the surface 102. By pushing the roller 106, the roller 106 together with the covers 108 and the axis of rotation 104 may be translated a certain distance below the surface 102, whereby an electrical switch is actuated. After releasing the roller 106, it will return to its original equilibrium position. Accordingly, when the switch 100 is mounted on a vertical face plate 102 of an electronic device with its axis of rotation oriented horizontally and located slightly behind the face plate 102, a user can roll his finger in an up/down motion over the switch to actuate the rotational mode of operation, can push the roller of the switch to the left or to the right to actuate the translational mode of operation, or can push the roller in a direction perpendicular to the face plate and thus perpendicular to the axis of rotation, whereby the pushing mode of operation is actuated.

When the multifunctional rotary switch 100 is operated in its rotational mode of operation 112, an incremental encoder or an analog potentiometer may be actuated, depending on the electronic device that is provided with the switch 100. An analog potentiometer is often desirable for the use with an audio device, where the rotational mode of operation 112 adjusts the audio volume. An incremental encoder may be desirable use for selecting or pre-selecting a function from a menu. Actuation of the switch 100 in the translational mode of operation 114 may actuates electric switches that are located in proximity to both end faces of the roller 106 in direction of the axis of rotation 104. Alternatively, the translational mode of operation 114 may also operate a linear potentiometer.

One example of how a multitude of functions can be accesses and executed by one example of an implementation of a multifunctional rotary switch 100 used in connection with an audio device is explained below. In the normal mode of operation of the audio device, operating the rotational mode of operation 112 increases or decreases the volume, depending on the direction of operation. For the purpose of this explanation, it may assumed that the switch 100 is mounted on the vertical face plate 102 of an audio device, with the axis of rotation 104 of the switch aligned horizontally and parallel to the surface of the face plate 102, as illustrated in FIG. 1. If the switch in its translational mode of operation 114 is now pushed to the right, a CD menu will appear on a display of the audio device. Rotating the roller 106 now no longer changes the volume of the audio device, but scrolls through the functions in the CD menu. After the user has pre-selected a certain function from the menu, he may operate the pushing mode of operation 116 by pushing the roller, whereby the pre-selected function is executed. In this manner, the user can for example skip to another song on a CD or stop playback of the CD. By pushing the switch 100 to the left, the function list of a radio menu may be displayed. Again, by rotating the roller 106, the user can now scroll through the functions of the radio menu. Once the user has pre-selected the desired function, such as selection of a stored channel or a change of the radio band, the user may execute the function by operating the pushing mode of operation 116. The function list of the menu may also include sub-menus that may be entered by operating the switch 100 in the same translational direction in which it was operated to enter the menu. To exit the sub-menu, the switch may be operated in the opposite translational direction. Alternatively, the roller may be pressed for a time longer than usual (so-called long press) to exit a sub-menu and go back to a higher menu level, or to go back to the top level menu (main menu). In this manner, large menu structures can easily be accessed by the compact multifunctional rotary switch 100.

It should be understood that the function of the multifunctional rotary switch is not limited to any of the above-mentioned functions or to audio devices, it may be integrated into navigation devices, portable music players, and other devices and may be used to operate the device according to the requirements of the particular device.

In one example of an implementation, the axis of rotation may be oriented substantially horizontally. If, however, the multifunctional rotary switch and is mounted to a vertical face plate of a car stereo, the horizontal orientation results in that the translational mode of operation is actuated by a left/right movement, whereas the rotational mode of operation is actuated by an up/down movement of the finger of the user. With this orientation, operating the switch 100 may be very intuitive, since function lists (menus) or song play lists are often displayed in one column with multiple rows, through which the user can scroll using the rotational mode of operation.

In another implementation, the axis of rotation may be oriented substantially vertically. For example, if the switch is mounted to the face plate of an electronic device that also includes a large display, the height of such an electronic device may be limited by the space available on the dashboard. The display usually takes up all the space in vertical direction, leaving only a small rim elongated in vertical direction on one side of the face plate of the electronic device. The multifunctional rotary switch could then be mounted to that rim in a vertical orientation. If the switch is mounted to other components, different orientations such as a horizontal orientation may be more desirable. For example, orienting the axis of rotation parallel to the surface of the component may be desirable since the translational mode of operation can be easily operated that way.

Figure 2:
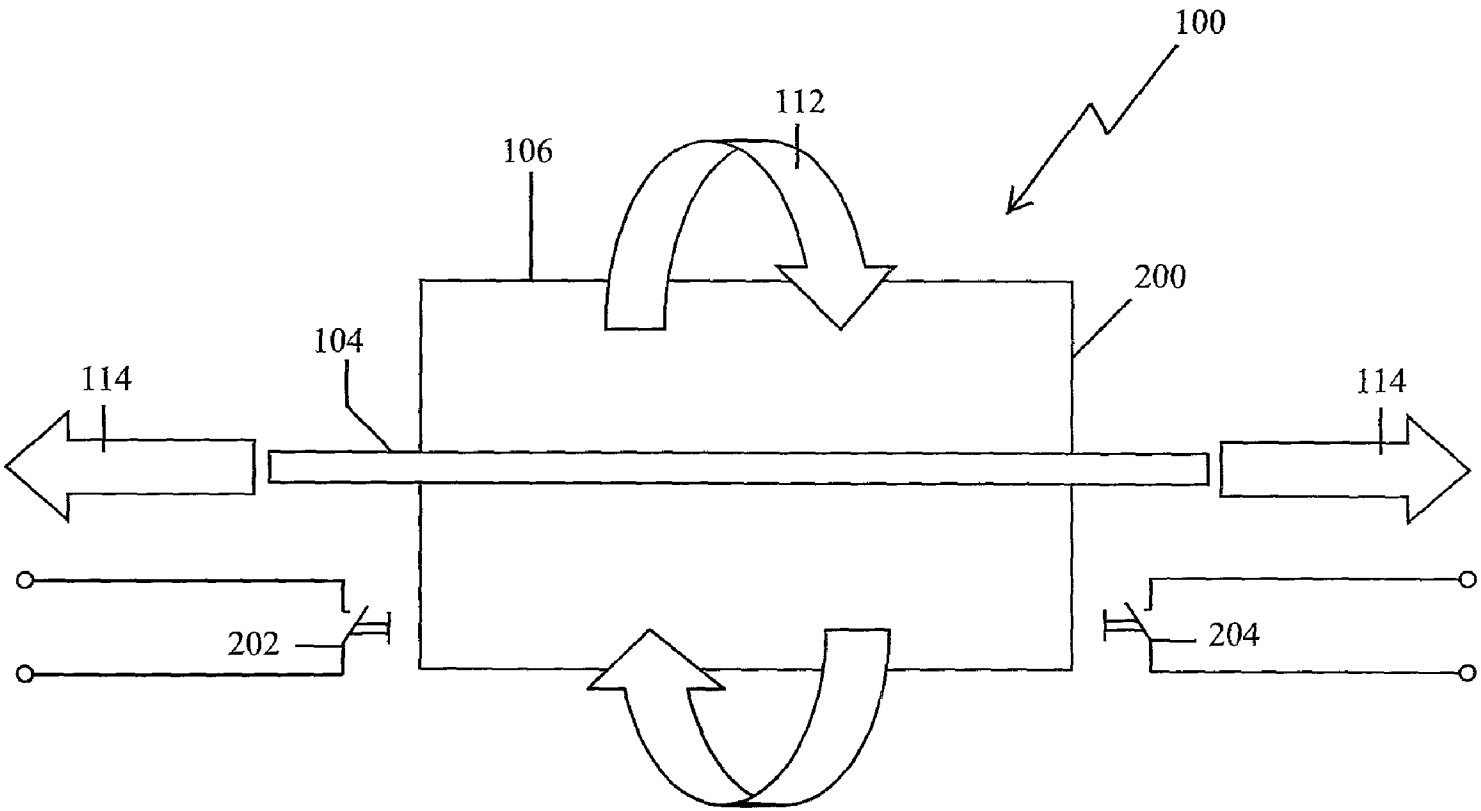
FIG. 2 is a cross-sectional view of the multifunctional rotary switch of FIG. 1 illustrating the location of the electrical switches.

FIG. 2 shows a cross-sectional view of one example of one implementation the multifunctional rotary switch 100 of FIG. 1. The roller 106 has a cylindrical shape and is mounted on the axis of rotation 104. The rotational mode of operation 112 is again indicated by arrows. As illustrated in FIG. 2, electrical switches 202, 204 may be arranged outside the roller 106 in proximity of each of the ends of the roller 106 along the axis of rotation. The electrical switches 202, 204 may be actuated by the ends or end faces of the roller 106 when the roller 106 is operated in the translational mode of operation 114. In the translational mode of operation 114, the operator pushes the roller 106 along its axis of rotation. Electrical switches 202, 204 are arranged next to each of the end faces of the roller such that when the roller is pushed in one direction, one end face of the roller contacts and actuates one switch 202, 204. If the roller is pushed in the other direction, the other end face contacts and actuates the other switch 202, 204. The electrical switches 202, 204 may be arranged below the surface 102 (see FIG. 1) to which the multifunctional rotary switch 100 is mounted. The roller 106 could be connected to the axis of rotation such that roller 106 and axis of rotation move together when the multifunctional rotary switch 100 is actuated in the translational mode of operation 114, or the roller 106 could move freely on the axis of rotation such that the axis of rotation stays fixed when the roller is actuated in the translational direction 114. If covers 108 are mounted on the end faces of the roller, then the outer surfaces of the covers 108 contact the electrical switches 202, 204 in a similar fashion.

The electrical switches 202, 204 may be spring loaded and mounted in such a way that when no other force is acting on the roller 106, the roller 106 is held and positioned in a central position. In that case, translational operation of the roller 106 in one or the other direction actuates the electrical switch 202 or 204 and has to occur against a spring force, which results in a repositioning of the roller 106 in its central position after the roller 106 is released.

The multifunctional rotary switch 100 may also include an arrest mechanism for arresting the rotation of the roller around said axis in the rotational mode of operation 112 at a predetermined angle. The multifunctional rotary switch 100 may also include a restoring mechanism for restoring the roller to a neutral position after it was operated in the rotational mode of operation and released. With such a roller functions, the roller 106 may be controlled in the rotational mode of operation 112 without having to turn the roller 106 for several revolutions.

Figure 3:
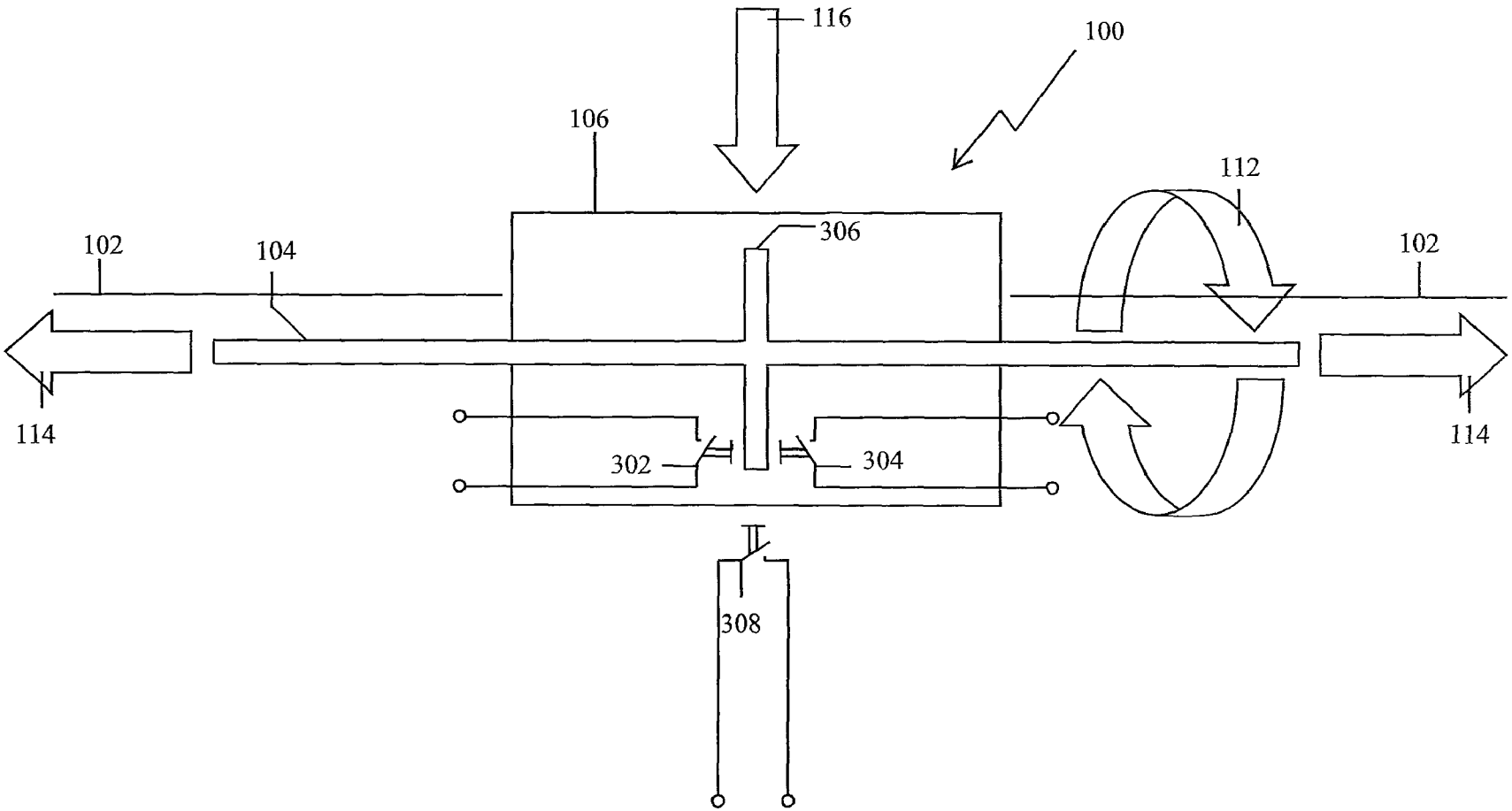
FIG. 3 is a cross-sectional view of another implementation of the multifunctional rotary switch showing an alternative arrangement of the electrical switches for the translational mode of operation.

As further illustrated in FIG. 3, it is also possible that electrical switches 302, 304 may be arranged inside the roller 106 on both sides of a switching lever 306, said switching lever 306 being moved together with the roller 106 when the roller 106 is operated in the translational mode of operation 114, where one of the electrical switches 302, 304 is switched by the switching lever depending on the direction of translational operation 114.

FIG. 3 is a cross-sectional view of another example of an implementation of a multifunctional rotary switch 100 of FIG. 1 having electrical switches 302, 304 arranged inside the roller 106. The switching lever 306 is connected to the axis of rotation 104 and is located within the roller 106. The switching lever 306 is further arranged substantially in the center of the roller. The roller 106 and the axis of rotation 104 are connected to each other and move with each other. The roller 106 is may be substantially hollow, having the electrical switches 302, 304 arranged inside the roller. The electrical switches 302, 304 do not move with the roller 106 but are fixed to the remaining part of the electronic device. Accordingly, the roller 106, the axis of rotation 104 and the switching lever 306 are moveable parallel to the axis of rotation, and the electrical switches 302, 304 are fixed.

Operation of the switch 100 in the translational mode of operation 114 actuates switch 302 or 304, depending on the direction of operation, through contact with the switching lever 306. As mentioned before the electrical switches 302, 304 may be spring loaded so that the switching lever 306 and thus the roller 106 are held in a central position. Mounting the electrical switches 302, 304 inside the roller 106 allows the multifunctional rotary switch 100 configuration to be more compact. The switching lever 306 may also be formed wider than depicted in FIG. 3. The switching lever 306 may in fact be formed with a width similar to that of the roller. In that case, the electrical switches 302, 304 would be located substantially outside the roller 106.

In the example illustrated in FIG. 3, an incremental encoder (not shown) may be located at either end of the axis of rotation 104, where it registers rotary movement of the roller 106 and the connected axis of rotation 104. A third electrical switch 308 may be mounted below the roller 106, with respect to the surface 102 of the component, and is actuated when the multifunctional rotary switch 100 is operated in the pushing mode of operation 116. To enable movement of the assembly of the roller 106, the axis of rotation 104 and the switching lever 306 is perpendicular to the surface 102 of the component. The ends of the axis of rotation 104 may be spring mounted. Alternatively, the operation of the switch 100 in the pushing mode of operation 116 may also be detected by electrical switches (not shown) at either or at both ends of the axis of rotation 104. Instead of moving the assembly, roller 106 may be spring mounted to the switching lever 306 or the axis of rotation 104 so that it can be moved relative to these components. That way, the pushing mode of operation 116 may be operated without moving the axis of rotation 104.

Figure 4:
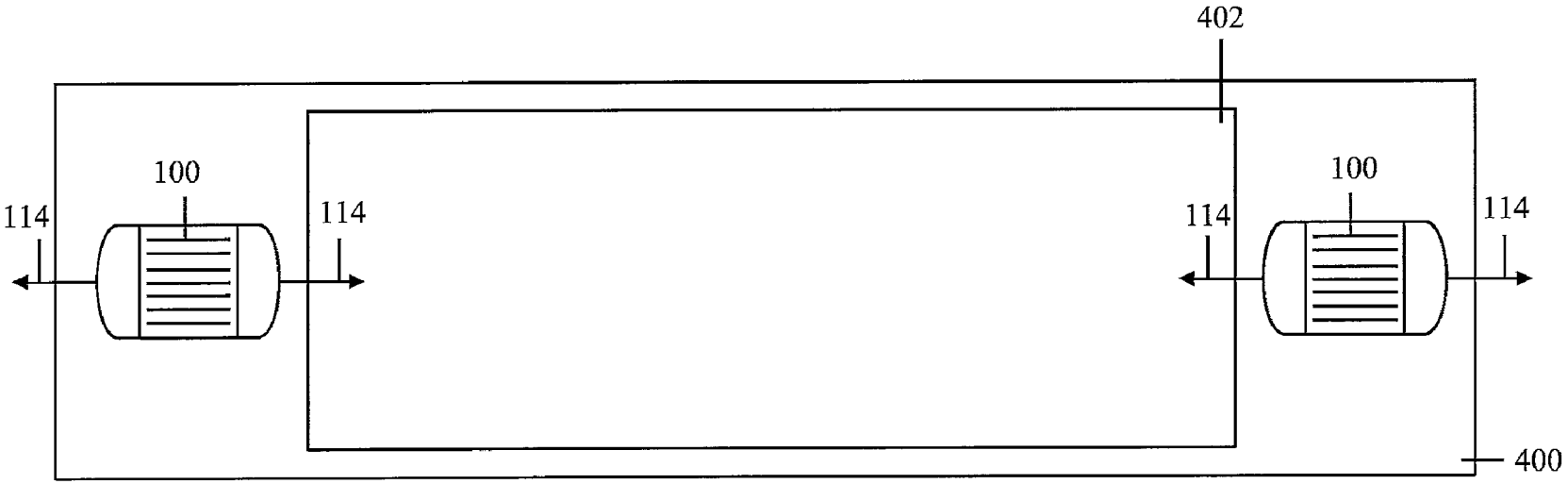
FIG. 4 is an example of a front view of a face plate of an audio device having two multifunctional rotary switches.

FIG. 4 is an example of a front view of a face plate 400 of an audio device having two multifunctional rotary switches 100. As illustrated, two multifunctional rotary switches 100 are mounted on the face plate 400. In the illustrated example, the face plate 400 includes a relatively large display 402 that leaves little space for any other operating elements. The switches 100 are mounted with their axis of rotation 104 in a horizontal direction, where the axes of rotation 104 may be disposed slightly below the surface of the face plate 400. In FIG. 4, the pushing mode of operation points to the drawing plane, whereas the translational mode of operation 114 points to the left and right as indicated by arrows. In the illustrated example, rotary actuation of the left switch 100 changes the volume of the audio device, whereas translational actuation 114 changes the tuning when the audio device is in radio mode or skips between songs of a CD when the audio device is in CD mode. The pushing mode of operation of the left switch 100 may be used to mute the audio device, or may have another function such as changing the functionality of the roller of the left switch 100 to adjusting the bass or the treble of the audio device. Actuation of the right multifunctional rotary switch 100 in the pushing mode of operation or the translational mode of operation 114 brings up a menu, for example a radio menu, a CD menu, or a configuration menu, depending on which operation was performed by the user. Once the menu is brought up on the display 402, the rotational mode of operation of the right switch 100 can be used to scroll through the different functions of the menu. These functions may also include sub-menus, which may be entered or left by operating the translational mode of operation of the right switch 100. Once a function has been pre-selected, it can be executed by operating the pushing mode of operation of the right switch. For example, the function could be the selection of a particular radio band in the radio menu, or the selection of a particular track of a CD in the CD menu, or the selection of particular display brightness in the configuration menu.

It must be understood that this is just an example of the use of the multifunctional rotary switch 100 in an electronic device. The switch 100 may also be used in other electronic devices and may be mounted in a variety of ways, for example, vertically. An electronic device may be provided with one or more multifunctional rotary switches. As shown in the illustrated example, the multifunctional rotary switch 100 may provide a high degree of functionality while taking up only a very small amount of space on the face plate of an electronic device. The multifunctional rotary switch 100 does not necessarily have to be integrated into the electronic device that it controls, it can also be integrated into other parts of the vehicle, such as the dashboard, the center console, or the steering wheel.

In one implementation, at least some of the functions of the electronic device that are operated by one of the multifunctional rotary switches 100 may differ from functions of the electronic device operated by the other of the multifunctional rotary switches 100. By providing two multifunctional rotary switches 100 with different functionality, the electronic device may be operated efficiently by using only a minimum amount of control elements.

Operating any of the modes of operation selects and executes a function of the electronic device. According to one example of an implementation, the translational mode of operation 114 is bidirectional and operates one function for each direction of operation, or operates the same function for both directions of operation. Operating of one function for each translational direction of operation 114 allows a multitude of functions to be accessed by the switch, whereas overrating the same function for both translational directions of operation 114 simplifies the operation of the electronic device. The simplified operation may, in certain situations, such as driving a car, allow the operator to easily perform simple functions, such as muting an audio device, when his full attention cannot be given to operating the electronic device.

In one example, operating the translational mode of operation 114 may bring up a menu on a display that is part of the electronic device, the type of menu depending on a direction of operation. When the switch is used in an audio device, operating the switch in one translational direction 114 may bring up a CD menu, whereas operating the switch in the other translational direction 114 may bring up a radio menu. In combination with a navigation device, operating the switch in one translational direction 114 may bring up a menu for the selection of a destination, whereas operating the switch in the other translational direction 114 may bring up a configuration menu for the navigation device. Thus, a multitude of functions can be accessed without having to go through several sub-menus.

In another example, operating the pushing mode of operation 112 may bring up a menu on a display that is part of the electronic device. In this manner, the menu can be directly accessed without having to go through any sub-menus. In combination with the translational mode of operation 114, three menus can be directly accessed, whereby a high degree of functionality is provided. A menu generally consists of a list of functions. A function in the menu may be pre-selected or selected by operating the rotational mode of operation. That means by rotating the roller in one or the other direction, a pre-selection indicator moves between the different functions in the menu. The user stops rotating the roller 106 once the pre-selection indicator points to the desired function. That function may remain pre-selected, meaning that the pre-selection indicator keeps pointing to that function, or may be executed. For example, if a play list of an audio device is brought up, rotating the roller 106 may scroll through the songs in the play list. As soon as the rotation is stopped, the song may be either marked by the pre-selection indicator, or may automatically start playing. Selecting a function in the menu by operating the rotational mode of operation 112 has the advantage that large lists can be accessed, for example play lists of an audio device or destination lists of a navigation device. Once a function has been pre-selected in the menu, the function may be confirmed or executed by operating the pushing mode of operation 116. For example, if the menu is a CD menu, and the play function was pre-selected, it can be executed by pushing the roller 106. In another example, if the menu is a play list, and a song was pre-selected, pushing the roller 106 may confirm the pre-selection and the song starts to play. Additionally, the pre-selected function may be automatically confirmed or executed after the function has been pre-selected for a predetermined amount of time. In this manner, the user does not need to perform another operation for selecting the desired function. Depending on the application, it may be preferably to execute the pre-selected function by either pushing the roller 106 or automatically executing the function after a predetermined amount of time.

As an example, a function may be confirmed or executed by operating the pushing mode of operation 116. This means that apart from bringing up a menu or executing a pre-selected function, operating the pushing mode of operation 116 may also directly execute a function. Such a function could for example be a "push to talk" function or an "ok" function. With the "ok" function a request from the electronic device may be confirmed.

Apart from scrolling through a menu list, the rotational mode of operation 112 may also be used to increase or decrease the volume of an audio device. That way, the roller 106 is provided with a direct functionality, which is easily accessible to the user. That functionality may change depending on the device that the multifunctional rotary switch 100 is mounted to or depending on the mode that the electronic device is currently working in. For example, in a combined audio and navigation device the rotational mode of operation 112 may increase and decrease the volume when the electronic device is in audio mode, whereas the rotational mode of operation 112 may zoom in and zoom out of a map when the electronic device is used for navigation. Alternatively, two multifunctional rotary switches 100 may be provided, one for controlling the audio mode (e.g., the volume), the other for controlling the navigational model.

In accordance with another example of an implementation, the rotational mode of operation 112 may operate either or both an incremental encoder or an analog potentiometer. When the multifunctional rotary switch 100 is used to adjust the volume of an audio device or other parameters that may need to be fine tuned, such as bass or treble of an audio device, it may be more desirable to operate an analog potentiometer. Furthermore, an analog potentiometer is very cost effective and does not require additional electronics. Operation of an incremental encoder may be more desirable for applications for which a digital input is required, such as the scrolling through function lists and the like. Operating an incremental encoder and an analog potentiometer simultaneously has the advantage that the function of the rotational mode of operation can be chosen according to the requirement of the application.

It is also possible to mount the multifunctional rotary switch 100 on a consumer electronic device. Consumer electronic devices can for example be handheld devices, such as portable navigation systems, portable audio players, portable organizers/personal computers or communication devices, or can for example be stationary devices, such as an audio system or an entertainment system. These devices are continuously becoming smaller, and/or their display areas are becoming larger, leaving little space for control elements. Thus, due to its compact size and its high degree of functionality, it may be desirable to mount the multifunctional rotary switch 100 to such a device. The switch may also be mounted to any automotive electronic device since even less space for control elements are available in an automotive environment. The switch 100 can, for example, be mounted on the dashboard of a vehicle or on a component that is mounted to the dashboard of a vehicle.

While the implementations of the invention disclosed are presently considered to be preferred, various changes and modifications can be made without departing from the spirit and scope of the invention. In particular, features of the above-mentioned implementations may be combined to form new implementations that are within the scope of the invention. The scope of the invention is indicated in the appended claims, and all changes that come within the meaning and range of equivalents are intended to be embraced therein. Accordingly, the foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

The invention claimed is:

1. A multifunctional rotary switch for operating an electronic device, the rotary switch comprising:

a roller with an axis of rotation, the roller having a bidirectional rotational mode of operation around the axis, and having a translational mode of operation, where the translation takes place substantially parallel to the axis of rotation, the roller further having a pushing mode of operation where the roller is moved in a direction substantially perpendicular to the axis of rotation; and at least one mechanism for detecting a movement parallel to the axis of rotation, where the mechanism is arranged substantially inside the roller.

2. The multifunctional rotary switch of claim 1, where the roller has a cylindrical shape, and that the axis of rotation is the symmetry axis of the cylinder.

3. The multifunctional rotary switch of claim 1, where the roller has the shape of a spindle with cut off tips, and that the axis of rotation is the symmetry axis of the spindle.

4. The multifunctional rotary switch of claim 1, where the roller has projections on its circumferential face where by the switch can be easily operated by hand without slipping.

5. The multifunctional rotary switch of claim 1, where the roller further includes covers at both end faces that are perpendicular to the axis of rotation.

6. The multifunctional rotary switch of claim 4, where the covers have a semi-spheroidal shape.

7. The multifunctional rotary switch of claim 1, where the roller is mounted in such a way that the axis of rotation of the roller is substantially parallel to the surface of a component on which the roller is mounted.

8. The multifunctional rotary switch of claim 1, where the multifunctional rotary switch is mounted on a front surface inside a vehicle.

9. The multifunctional rotary switch of claim 1, further including electrical switches arranged outside the roller in proximity of each of the ends of the roller along the axis of rotation, the electrical switches being actuated by an end of the roller when the roller is operated in the translational mode of operation.

10. The multifunctional rotary switch of claim 1, where the roller further includes a switching lever arranged inside the roller and electrical switches arranged inside the roller on both sides of a switching lever, where the switching lever is moved together with the roller when the roller is operated in the translational mode of operation and where one of the electrical switches is switched by the switching lever depending on the direction of translational operation.

11. The multifunctional rotary switch of claim 1, characterized in that operating any of the modes of operation selects and executes a function of the electronic device.

12. The multifunctional rotary switch of claim 1, where the translational mode of operation is bidirectional and operates one function for each direction of operation.

13. The multifunctional rotary switch of claim 1, where the translational mode of operation is bidirectional and operates the same function for both directions of operation.

14. The multifunctional rotary switch of claim 1, where operating the translational mode of operation brings up a menu on a display that is part of the electronic device.

15. The multifunctional rotary switch of claim 1, where the pushing mode of operation brings up a menu on a display that is part of the electronic device.

16. The multifunctional rotary switch of claim 14, where a function in the menu is selected by operating the rotational mode of operation.

17. The multifunctional rotary switch of claim 16, where a function is executed by operating the pushing mode of operation.

18. The multifunctional rotary switch of claim 16, where a selected function in the menu is automatically executed after the function has been selected for a predetermined amount of time.

19. The multifunctional rotary switch of claim 1, where operating the rotational mode of operation increases or decreases the volume of an audio device.

20. The multifunctional rotary switch of claim 1, where operating the rotational mode of operation operates either or both an incremental encoder or an analogue potentiometer.

21. The multifunctional rotary switch of claim 1, characterized in that the multifunctional rotary switch is mounted on a consumer electronic device.

22. The multifunctional rotary switch of claim 1, characterized in that the multifunctional rotary switch is mounted on an automotive electronic device.

23. The multifunctional rotary switch of claim 1, further comprising an arrest mechanism for arresting the rotation of the roller around the axis in the rotational mode of operation at a predetermined angle.

24. An electronic device comprising at least a first and second multifunctional rotary switches, where both the first and second rotary switches including a roller with an axis of rotation, the roller further having a bidirectional rotational mode of operation around the axis, a translational mode of operation parallel to the axis and a pushing mode of operation perpendicular to the axis, and at least one mechanism for detecting movement parallel to the axis of rotation, where the mechanism is arranged substantially inside the roller, where at least some functions of the electronic device operated by the first multifunctional rotary switch differ from functions of the electronic device operated by the second multifunctional rotary switch.

* * * * *